United States Patent [19]

Mori

[11] Patent Number: 4,586,668

[45] Date of Patent: May 6, 1986

[54] BOBBIN CONVEYING SYSTEM

[75] Inventor: Shigeki Mori, Inuyama, Japan

[73] Assignee: Murata Kikai Kabushiki Kaisha, Japan

[21] Appl. No.: 540,009

[22] Filed: Oct. 7, 1983

[30] Foreign Application Priority Data

Oct. 12, 1982 [JP] Japan ..... 57-179269

[51] Int. Cl.[4] ..... B65H 67/06

[52] U.S. Cl. ..... 242/35.5 A; 28/292; 57/276; 198/533; 221/13; 221/171

[58] Field of Search ..... 242/35.5 A, 35.5 R, 242/35.6 R; 57/274, 276; 198/533, 538, 651, 400; 221/13, 171, 172; 209/927; 28/292

[56] References Cited

U.S. PATENT DOCUMENTS 3,531,016 9/1970 Pray ..... 221/13
4,181,228 1/1980 Hashimoto et al. ..... 242/35.5 A X
4,307,807 12/1981 Oswald et al. ..... 57/274 X
4,432,198 2/1984 D'Agnolo ..... 242/35.5 R X

FOREIGN PATENT DOCUMENTS 3213253 10/1982 Fed. Rep. of Germany ..... 242/35.5 A

*Primary Examiner*—Stanley N. Gilreath
*Attorney, Agent, or Firm*—Spensley Horn Jubas & Lubitz

[57] ABSTRACT

A cop and bobbin conveying system including a cop feeding lines and bobbin ejecting lines which are interconnecting fine spinning frames and a winder. The cops and bobbins are conveyed by carrier members on which they are fitted and carried. A bobbin supplying device for supplying a bobbin on an empty carrier member is provided at the intermediate portion of the bobbin ejecting line.

9 Claims, 7 Drawing Figures

BOBBIN CONVEYING SYSTEM

BACKGROUND OF THE INVENTION

The present invention relates to a bobbin conveying system including a cop conveying apparatus directly interconnecting spinning frames and an automatic winder.

The present invention discloses a cop supplying system in which fine spinning frames and an automatic winder are interconnected directly by cop feeding lines, cops doffed from the fine spinning frames are conveyed to the automatic winder by being carried on individual cop carrier member (designated as "trays" hereinafter), and the trays carrying the cops are fed to each winding unit of the automatic winder to rewind the yarns from the cops fitted on the trays and the trays with bobbins are discharged from the winding units. In such a cop supplying system, it is necessary that the trays carrying cops are conveyed regularly along the conveying line to convey the trays from the fine spinning frames to the automatic winder, while the trays carrying empty bobbins are conveyed regularly along the conveying line for feeding the trays carrying bobbins from the automatic winder to the spinning frame. Since the conveying line for feeding cops from the fine spinning frame to the automatic winder conveys cops doffed simultaneously from the fine spinning frame, all the trays on the same conveying line are loaded with cops, whereas there are some trays which do not carry the bobbin thereon, on the conveying line for ejecting bobbins from the automatic winder to the fine spinning frame.

That is, among the trays discharged from the automatic winder, some carry bobbins with residual yarns of a reasonable amount for reuse, while some carry bobbins with minimum residual waste yarns which can not be used. Those trays carrying bobbins with residual yarns are not returned to the spinning frame, but are refed to the automatic winder, while the trays carrying bobbins with no residual yarn are returned to the fine spinning frame. However, in some cases, those bobbins with residual waste yarns are removed from the trays and are accumulated for manual treatment by operators. In such a case, the trays which carry no bobbin thereon are incapable of feeding bobbins to the fine spinning frame even if those trays are returned to the fine spinning frame, which is extremely unfavorable to the automatic simultaneous doffing system.

SUMMARY OF THE INVENTION

The present invention relates to a cop and bobbin conveying system including a closed loop of cop feeding lines and bobbin ejecting lines which are interconnecting fine spinning frames and an automatic winder. The cops and bobbins are conveyed by carrier members on which the cops and bobbins are erected and carried.

An object of the present invention is to provide an improved system in which all carrier members are transferred to the spinning frames with bobbins thereon.

According to the present invention, a bobbin supplying device for supplying an empty bobbin on the carrier member is provided at the intermediate portion of the bobbin ejecting line.

DETAILED DESCRIPTION OF THE INVENTION

A preferred embodiment of the present invention will be described hereinafter in connection with the accompanying drawings.

Figure 1:
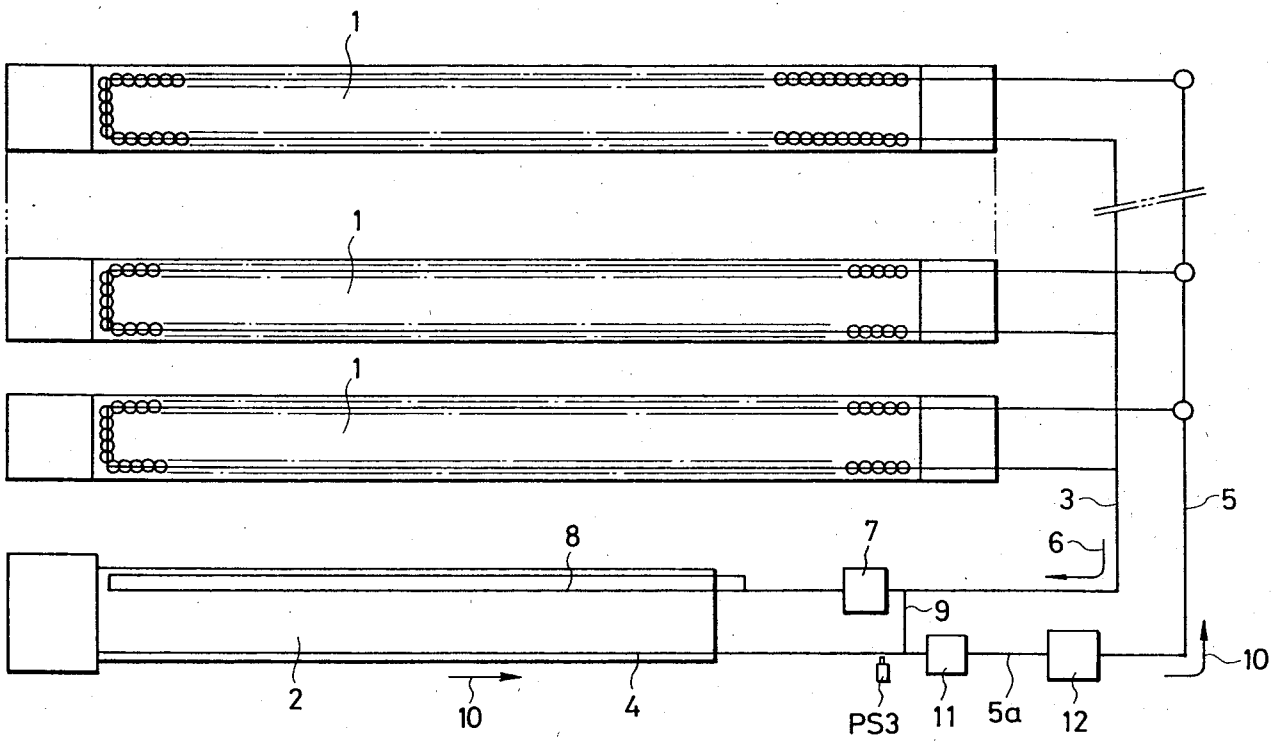
FIG. 1 is a representation of an exemplary layout of a bobbin conveying system according to the present invention.

FIG. 1 shows an exemplary cop and bobbin conveying system directly interconnecting fine spinning frames 1 and a winder 2. A plurality of fine spinning frames 1 and single or a plurality of winders 2 of the corresponding capacity are interconnected directly by a closed loop consisting of cop feeding lines 3 and bobbin ejecting lines 4 and 5. The cops doffed from the fine spinning frame 1 are fitted on trays serving as carrier members and are conveyed along the cop feeding line 3 in the direction of an arrow 6. A readying device 7 for seeking and removing a starting end of yarn from a spinning cop is disposed in the cop feeding line 3 to seek the yarn ends of the cops carried on the trays before those cops are fed to the winder 2. The trays carrying cops each with the yarn end sought out are transferred to a cop feeding line 8 extending along one side of the winder 2, and then are fed to the winding units of the winder. The tray discharged from the winding unit and carrying a bobbin is conveyed along the bobbin ejecting line 4. Bobbins having reasonable residual yarns are refed through a by-pass line 9 to the reading device 7. Bobbins are conveyed in the direction of an arrow 10 and are fed to the fine spinning frame 1. The bobbins having residual waste yarns are removed from the tray by a bobbin unloading device 11, and the empty tray is conveyed along the bobbin ejecting line 5*a* to an bobbin supplying device 12, where a bobbin is supplied to the empty tray. The tray thus carrying a bobbin is conveyed along the bobbin ejecting line 5 in the direction of the arrow 10 and is fed to the fine spinning frame 1.

Figure 2:
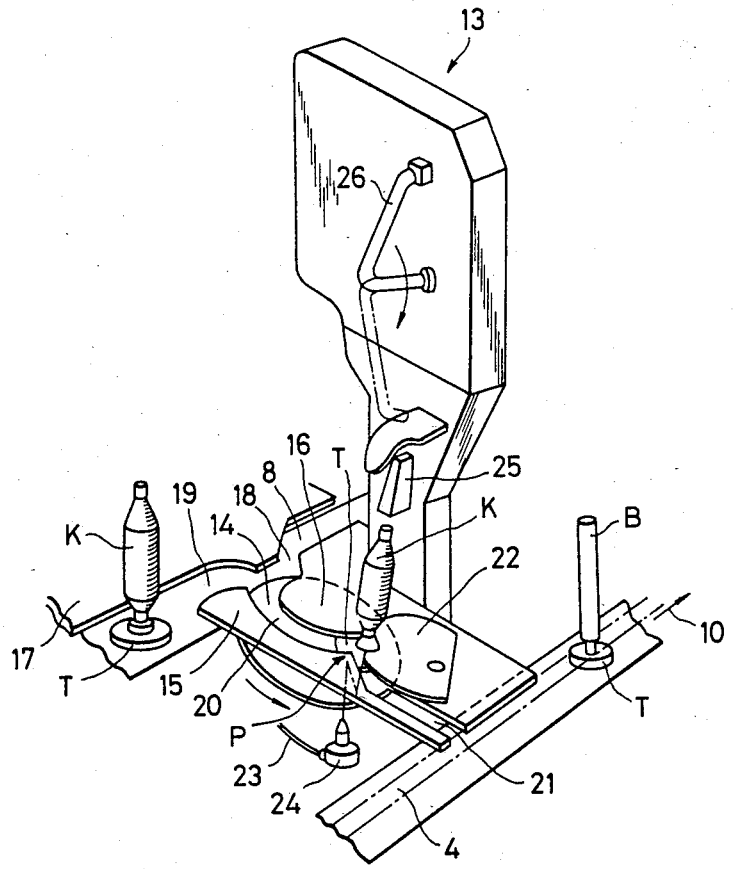
FIG. 2 is a perspective view of an exemplary winding unit, showing the general constitution thereof.

FIG. 2 shows an exemplary winding unit of the winder applied to the above bobbin conveying system. The winder 2 comprises a plurality of winding units 13 disposed in an array between the cop feeding line 8 and the bobbin ejecting line 4. A rotary disk 14 feeds a cop from the cop feeding line 8 to the winding position P and discharges the bobbin from the winding position P to the bobbin ejecting line 4 after all the yarn of the cop has been wound up on a yarn package. The surface of the rotary disk 14 is inclined with respect to a horizontal plane with the side thereof adjacent to the cop feeding line 8 raised relatively to the side thereof adjacent to the bobbin ejecting line 4. Guide plates 15 and 16 are disposed at a fixed space above the rotary disk 14. A cop inlet 18 and a cop outlet 19 are formed between the guide plate 16 and a guide plate 17 and between the guide plate 15 and the guide plate 17 respectively. A cop reserve line 20 and a bobbin eject line 21 are formed between the guide plates 15 and 16. The cop reserve line 20 and the bobbin eject line 21 join at the yarn running position P in the winding unit. An bobbin ejecting lever for discharging a bobbin after all the yarn wound thereon has been wound up on a yarn package is indicated by a reference numeral 22.

A compressed air jet nozzle 24 is disposed below a tray at the yarn running position P. The compressed air jet nozzle 24 is connected by a conduit 23 to a source of compressed air, not shown. Compressed air is jetted by the nozzle 24 through the peg of a tray T into the bore of a bobbin to blow the yarn end suspended within the bore from the top of the bobbin outside of the bobbin. Known members, such as a balloon breaker 25, a relay-pipe 26 to lead the yarn end of a cop K located at the winding position P or a suction mouth for leading the yarn end of the yarn package, not shown, to the knotter, and a yarn detecting device, are disposed above the cop K located at the yarn running position P.

Figure 3:
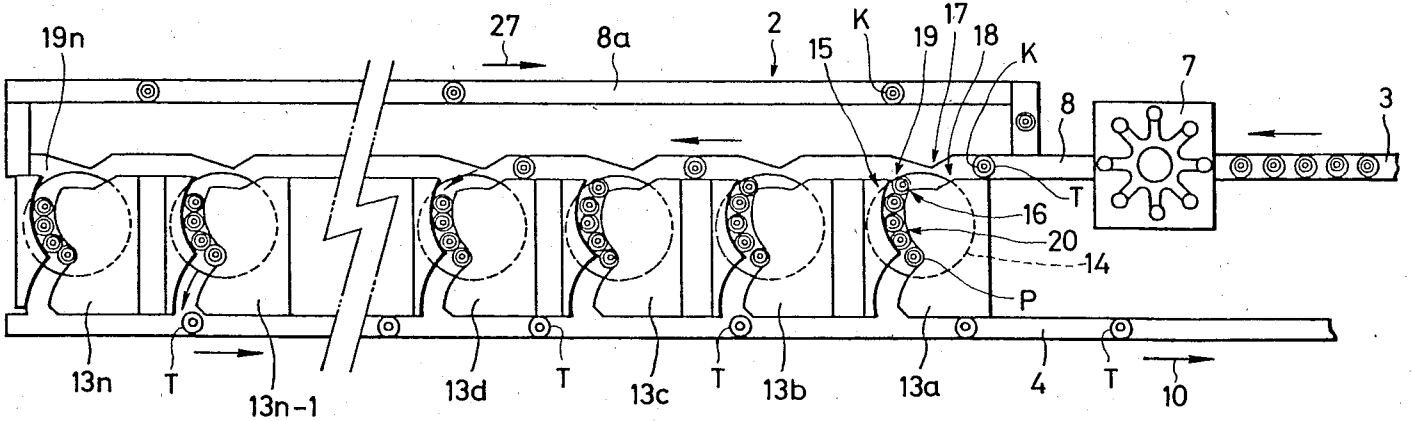
FIG. 3 is a schematic illustration of the winding units, for facilitating the explanation of the cop supplying procedure in a winder.

FIG. 3 is a plan view for facilitating the explanation of the cop supplying procedure for supplying cops to the winder having an array of a plurality of the winding units 13. Referring to FIG. 3, a cop is conveyed along the cop feeding line 3 to the yarn end readying device 7. The yarn end readying device 7 seeks out the yarn end of the cop to prepare for knitting and put the yarn end into the bore of the bobbin. Then, the cop with the yarn end put in the bobbin thereof and as fitted on a tray is transferred to the cop feeding line 8 of the winder. As the cop K is carried along the cop feeding line 8, the tray T of the cop K is guided by the guide plates 15, 16 and 17 of a winding unit 13*a* onto the rotary disk 14 so that the cop K enters the cop reserve line 20 through the cop inlet 18 and is finally moved to the yarn running position P by the agency of the inclination and the rotary motion of the rotary disk 14. In this procedure, the following trays T are taken successively into the cop reserve line 20. When the cop reserve line 20 is filled up with the trays (five trays in FIG. 3), the following trays are not allowed to enter the cop reserve line 20 of the winding unit 13*a* and are sent out through the cop outlet 19 to the next winding unit 13*b*. Thus the cop reserve line 20 of the winding units are filled sequentially with the trays T each carrying a cop K from the winding unit 13*a* through the winding unit 13*n*. If unoccupied spaces are made in the cop reserve line 20 during the sequential feeding of the cops, those unoccupied spaces also are filled sequentially with the trays T each carrying a cop from the winding unit nearest the winding unit 13*a*. The trays which are not allowed to enter the cop reserve line of any one of the winding units 13*a* to 13*n*, are moved into a recirculating line 8*a* after having passed through the cop outlet 19*n* of the last winding unit 13*n* to be moved in the direction of an arrow 27 and are fed again to the cop feeding line 8.

Figure 4:
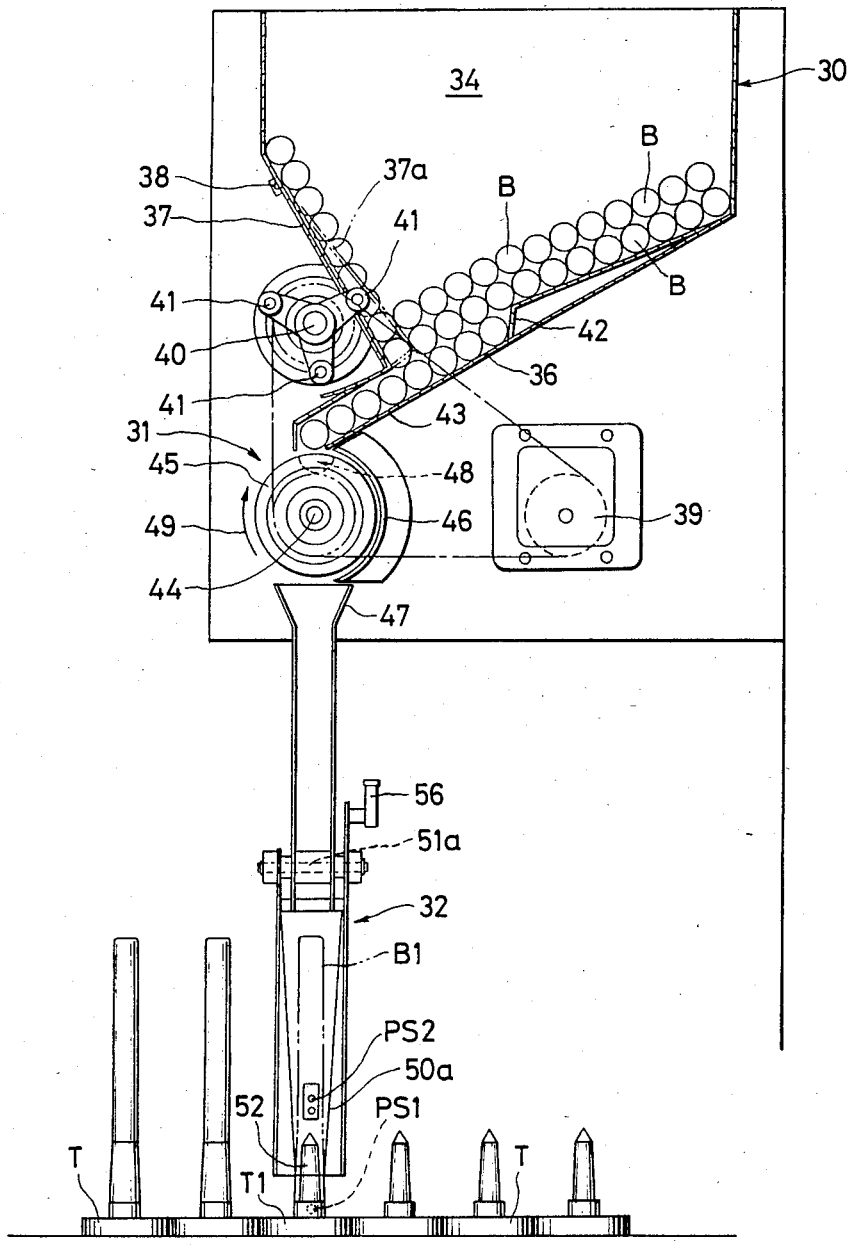
FIG. 4 is a sectional side elevation of a preferred embodiment of a bobbin supplying device included in the bobbin conveying system of the present invention.

Among the bobbins discharged from the winding units 13*a* to 13*n*, the bobbins having a very small amount of residual yarns are removed from the corresponding trays. The empty trays are fed to the bobbin supplying device 12 whereby bobbins are fitted on the empty trays respectively. A preferred embodiment of the bobbin supplying device will be described hereinafter in connection with FIGS. 4 to 6.

The bobbin supplying device 12 comprises; a bobbin hopper 30, a bobbin ejecting device 31 capable of releasing stocked bobbins one by one, a bobbin fitting device 32 capable of fitting a bobbin on a tray placed on the conveying line, and a detecting device 33 for detecting whether an empty tray or a tray with a bobbin fitted thereon is conveyed.

The bobbin hopper 30 is formed of side walls 34 and 35 which are arranged in parallel with a distance practically the same as the length of the bobbin, an inclined bottom wall 36 and a levelling plate 37. A plurality of bobbins B are contained in the bobbin hopper 30 in the same posture. The levelling plate 37 is a practically L-shaped plate and is capable of swinging about a shaft 38 between a position illustrated by solid lines and a position 37*a* illustrated by two dotted and chain lines. Three pushing rollers 41 arranged at three angular positions respectively and mounted on a shaft 40 adapted to be driven by a motor 39 cause the levelling plate 37 to swing. A disturbing plate 42 is provided to disturb the posture of the bobbins. The cooperative action of the disturbing plate 42 and the levelling plate 37 prevents choking of the bobbins in the hopper 30, so that the bobbins are arranged orderly in succession in a discharging passage 43.

The bobbin ejecting device 31 is disposed below the opening end of the ejecting passage. The ejecting device 31 comprises a releasing drum 45 adapted to rotate intermittently on a shaft 44 extending practically in parallel to the longidudinal axis of the bobbin, a drum cover 46 and a chute 47. The releasing drum 45 is formed of a cylindrical member having a practically semicylindrical groove 48 formed in the circumference thereof for receiving a bobbin therein. After having received a bobbin in the semicylindrical groove 48, the releasing drum 45 rotates in the direction of an arrow 49. When the groove 48 arrives at a position above the upper end of the chute 47, the bobbin falls free. During the rotation of the drum 45, the succeeding bobbin is in contact with and is retained by the circumference of the drum 45.

Figure 5:
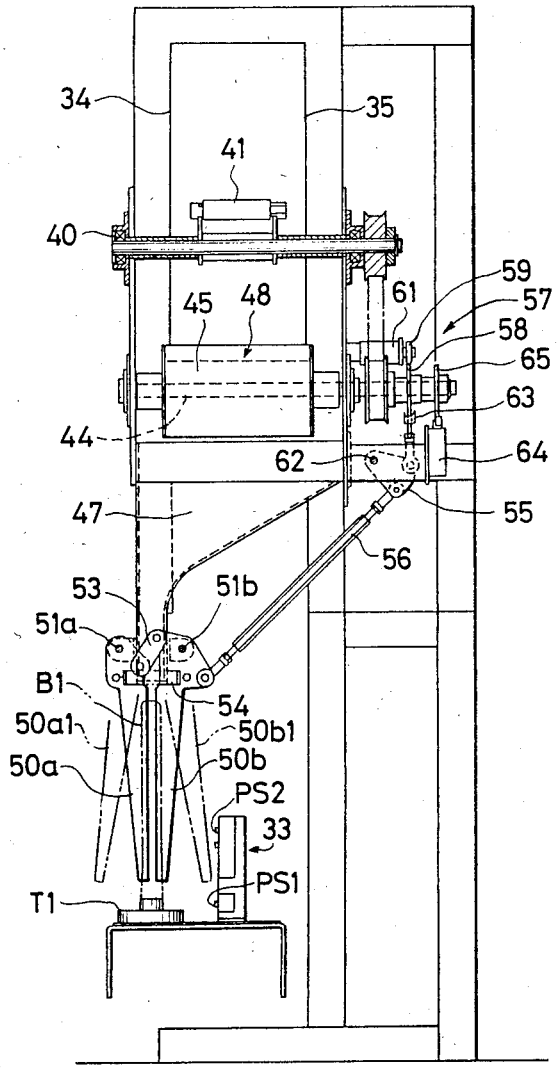
FIG. 5 is a front elevation of the bobbin supplying device of FIG. 4.
Figure 6:
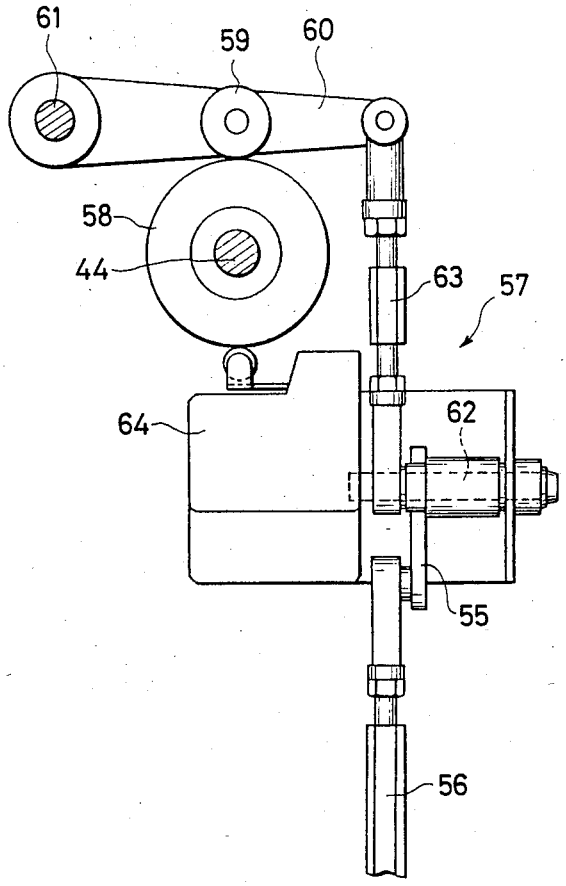
FIG. 6 is a side elevation of a driving mechanism for driving the bobbin supplying device of FIG. 4.

The empty bobbin fitting device 32 comprises the chute 47 designed to let the bobbin fall therethrough in a controlled posture, and bobbin guides 50*a* and 50*b* adapted to open and close the bottom opening of the chute 47. The bobbin guides 50*a* and 50*b* are adapted to swing about shafts 51*a* and 51*b* respectively in a plane extending perpendicularly with respect to the tray conveying direction. When they are closed as illustrated by solid lines in FIG. 5, the guides 50*a* and 50*b* form a guide hole for guiding a bobbin in alignment with the peg 52 of a tray T1 waiting thereunder. When the guides 50*a* and 50*b* are opened as illustrated by two dotted and chain lines 50*a*1 and 50*b*1 in FIG. 5, the tray T1 carrying a bobbin B1 is allowed to move through the space between the guides 50*a* and 50*b* in a direction parallel to the conveyor. The bobbin guides 50*a* and 50*b* are linked with a link 53 and are biased by a spring 54 to the closed positions. The lower end of a rod 56 joined at the upper end thereof to a rocking lever 55 is joined to the bobbin guide 50*b*. A driving mechanism 57 for driving the rod 56 is shown in FIGS. 5 and 6.

A cam 58 fixed to a shaft 44 rotated by the motor 39 (FIG. 4) causes, through a cam follower 59, a lever 60 to rock about a fixed shaft 61. One end of the lever 60 and a rocking lever 55 pivotally supported on a fixed shaft 62 are interconnected by a rod 63. Thus, the rocking lever 55 performs one reciprocating motion as the cam 58 performs one full rotation, and hence the bobbin guides 50*a* and 50*b* are caused through the rod 56 to perform one reciprocating motion, namely, to open and to close. A cam 65 fixedly mounted on one end of the driving shaft 44 actuates a limit switch 64 at every single turn of the shaft 44 to stop the motor.

The detecting device 33 for discriminating the presence of the bobbin and a tray stopping member are disposed on the side of the bobbin ejecting line 4. Photoelectric sensors PS1 and PS2, for instance, are disposed at positions corresponding the bobbin receiving position of the tray T1 and the position of the bobbin as fitted on the tray. The sensor PS1 detects the arrival of the tray T1 at the bobbin receiving position. Upon the detection of the existence of a bobbin on the tray, the sensor PS2 gives a signal to release the stopping member, which will be described afterward, allowing the detected tray to advance. On the other hand, upon the detection of the absence of a bobbin on the tray, the sensor PS2 gives a signal to actuate the motor 39, and thereby one bobbin is discharged from the empty bobbin hopper 30 and is fitted on the empty tray. A safety device is provided to interrupt the operation of the bobbin supplying device and to light an alarm lamp, in case the sensor PS2 will not function within a predetermined period of time after the sensor has detected the arrival of a tray. For example, provided that the cycle time of the bobbin supplying operation is 3 sec., the bobbin supplying device is decided to be in an abnormal condition, when the sensor PS2 will not function in 18 sec. after a timer has been actuated upon the detection of the arrival of a tray by the sensor PS1.

Figure 7:
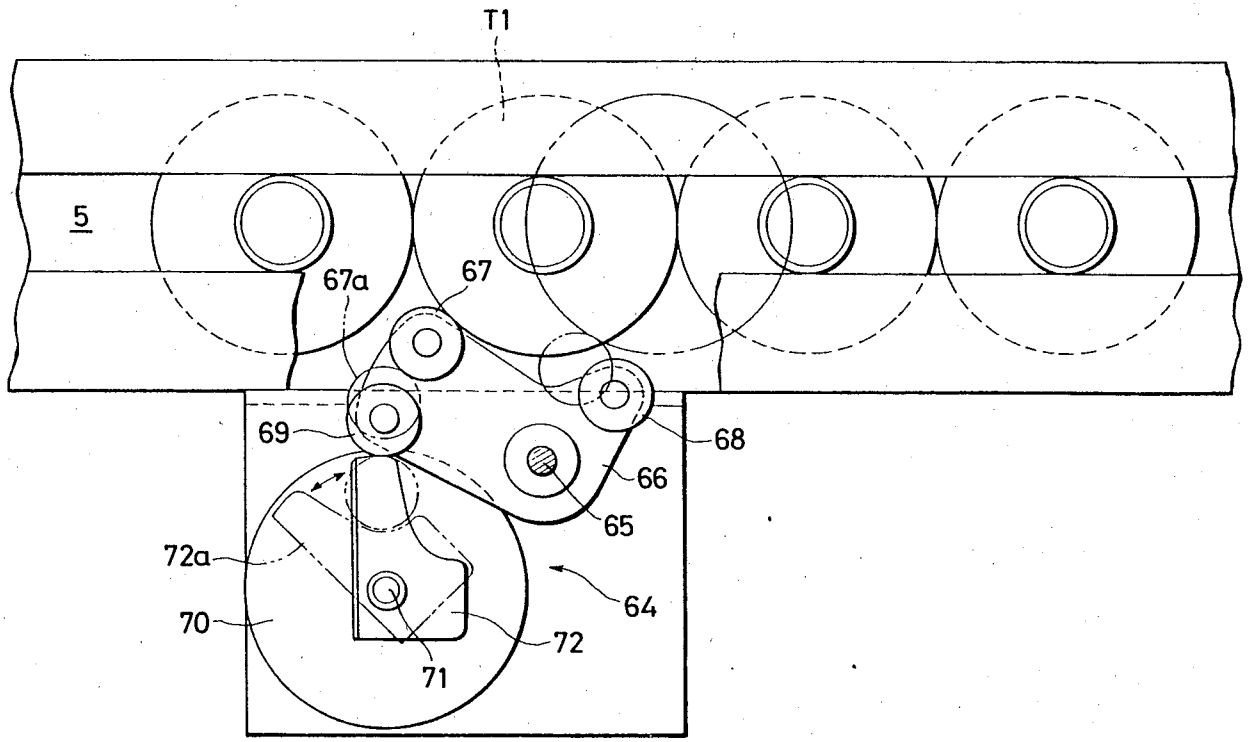
FIG. 7 is a plan view of a stopper member disposed in the tray conveying line to stop a tray.

FIG. 7 is a plan view of the stopping member 64. Rollers 67, 68 and 69 are mounted rotatably at three positions respectively on a plate 66 capable of swinging about a fixed shaft 65. The roller 67 functions to locate a tray at the bobbin receiving position, the roller 68 functions to restrain the succeeding tray temporarily while the preceeding tray carrying a bobbin is sent out and the roller 69 is moved by a cam 72 fixedly mounted on the shaft 71 of a rotary solenoid 70 to cause the plate 66 to swing. While the cam 72 is at a position illustrated by solid lines, the roller 67 is projected into the conveying line 5 to locate a tray at the bobbin receiving position on the conveying line. The rotary solenoid 70 is energized, when the sensor PS2 shown in FIG. 5 detects the existence of a bobbin on the tray, to turn the cam 72 to a position 72*a* illustrated by two dotted and chain lines with the roller 69 following the cam 72. Accordingly, the plate 66 also is turned and the roller 67 is moved to a position 67*a* illustrated by two dotted and chain lines, to allow the tray T1 to advance.

The operation of the cop conveying system having the bobbin supplying device as described hereinbefore will be described hereinafter.

Referring to FIGS. 1 to 3, bobbins discharged from the winding units 13 are transported along the bobbin ejecting line 4 in the direction of the arrow 10. Upon the detection of a bobbin having residual yarn, a sensor PS3 (FIG. 1) actuates a gate, not shown, to transfer the bobbin to the by-pass line 9. Other bobbins, namely, bobbins having a very small amount of residual yarn and bobbins, with no yarn are transported to the bobbin unloading device 11, where the bobbins having a very small amount of residual yarn are extracted from the corresponding trays and the empty trays are transferred to the bobbin ejecting line 5*a*. Trays carrying empty bobbins are allowed to pass through the bobbin unloading device 11.

In the bobbin supplying device 12, the bobbin guides 50*a* and 50*b* are in the open positions 50*a*1 and 50*b*1 respectively as illustrated by two dotted and chain lines in FIG. 5, waiting for the coming tray T1, which is empty or carrying a bobbin. The tray T1 is stopped temporarily at the bobbin fitting position defined by the stopping member 64. When the tray T1 is empty, the sensor PS2 detects the absence of bobbin and gives a signal to actuate the motor 39 shown in FIGS. 4 and 5. Consequently, one bobbin is discharged from the bobbin hopper 30 and is put into the chute 47, while the bobbin guides 50*a* and 50*b* are closed as illustrated by solid lines in FIG. 5, and thereby the bobbin is guided to and is fitted on the tray T1 located directly below the chute 47. Then, the sensor PS2 detects the bobbin B1 fitted on the tray T1 and gives a signal to actuate the rotary solenoid 70 of the stopping member to release the stopping member, and thereby the tray T1 carrying a bobbin is allowed to start moving along the bobbin ejecting line 5.

The bobbin guides 50*a* and 50*b* are controlled by a cam so as to be opened in a timed relation with the fitting of a bobbin on a tray, therefore, the bobbin guides 50*a* and 50*b* have already been opened before the tray starts moving again. Thus, bobbins are fitted on empty trays respectively, therefore, every tray being conveyed toward the fine spinning frames along the bobbin ejecting line 5 carries a bobbin.

As described hereinbefore, the bobbin conveying system according to the present invention comprises a closed loop of cop feeding lines and bobbin ejecting lines, directly interconnecting fine spinning frames and a winder; a plurality of carrier members, namely, trays, circulated through the closed loop to transport cops and bobbins; and a bobbin supplying device disposed within the bobbin ejecting line to supply a bobbin to an empty tray. Accordingly, every tray being transported along the bobbin ejecting line toward the fine spinning frames carries a bobbin, a bobbin is supplied to each spinning unit of the fine spinning frame to wind the spun yarn and the cops of all the spinning units of the fine spinning frame can be replaced simultaneously with bobbins respectively during the simultaneous automatic doffing operation. Thus the bobbin conveying system of the present invention secures reliable automatic doffing operation in the fine spinning frame.

What is claimed is:

1. A bobbin conveying system of a type having carrier members with bobbins and carrier members without bobbins wherein said system comprises:

spinning frames for forming cops;

a winder for winding yarn from cops;

a closed loop of cop feeding lines and bobbin ejecting lines directly interconnecting said spinning frames and said winder, wherein cops and bobbins which are transported and circulated through said closed loop are fitted on carrier members, wherein carrier members fitted with cops thereon are transported from said spinning frames to said winder and carrier members fitted with bobbins thereon are transported from said winder to said spinning frames; and a bobbin supplying device, located downstream from said winder along said bobbin ejecting line, said bobbin supplying device including a discrimination means for sensing whether or not said carrier members which are transported from said winder to said bobbin supplying device have a bobbin thereon and means responsive to said discriminating means for supplying a bobbin to a carrier member which does not have a bobbin thereon.

2. A bobbin conveying system as claimed in claim 1, wherein a bobbin unloading device for removing a bobbin having residual waste yarn wound thereon is further provided between the winding unit and the bobbin supplying device along the bobbin ejecting line.

3. A bobbin supplying device for supplying a bobbin to a carrier member which is a disk-like tray for supporting and carrying a cop or a bobbin to be erected thereon, said carrier member being circulated and transported along a line comprising:

a bobbin hopper to store a plurality of bobbins therein, said bobbin hopper having a discharging passage through which said bobbins may pass;

a bobbin ejecting device, located below said discharging passage for receiving a bobbin from said bobbin hopper and releasing said bobbins one by one;

a bobbin fitting device, located below said bobbin ejecting device, for receiving said bobbin from said bobbin ejecting device and fitting said bobbin on said carrier member; and a discrimination means for sensing whether or not said carrier members moving along said line have a bobbin thereon, wherein said bobbin supplying device supplies bobbins to carrier members which do not have a bobbin.

4. A bobbin supplying device as claimed in claim 3, wherein said bobbin hopper has a levelling plate being swingable for restraining and orienting said bobbins; and said bobbin hopper has a disturbing plate, located at a bottom of said hopper, for disrupting a path of said bobbins, wherein a cooperative action between said distrubing plate and said levelling plate prevents choking of said bobbins stored within said bobbin hopper so that said bobbins are arranged orderly in succession in a discharging passage of said hopper.

5. A bobbin supplying device as claimed in claim 4, wherein said bobbin ejecting device comprises a releasing drum intermittently rotatable and having a substantially semicylindrical groove formed in the circumference thereof for receiving a bobbin therein and said drum also having a drum cover for covering a portion of a surface of said drum located between said discharge passage and said bobbin fitting device.

6. A bobbin supplying device as claimed in claim 5, wherein said bobbin fitting device comprises a chute located below said releasing drum for receiving a bobbin from said releasing drum, and through which said bobbin falls;

said bobbin fitting device having bobbin guides for opening and closing a bottom opening of said chute; and said bobbin fitting device having a driving mechanism for opening and closing said bobbin guides.

7. A bobbin conveying system as claimed in claim 1, wherein each said carrier member is a disk-like tray and wherein said bobbin supplying device comprises:

a bobbin hopper to store a plurality of bobbins therein, said bobbin hopper having a discharging passage through which said bobbins may pass;

a bobbin ejecting device, located below said discharging passage, for receiving a bobbin from said bobbin hopper and releasing said bobbins one by one;

a bobbin fitting device, located below said bobbin ejecting device, for receiving said bobbin from said bobbin ejecting device and fitting said bobbins on said carrier member; and a stopping device, located on a side of said bobbin ejecting line below said bobbin fitting device, for stopping and releasing said carrier member, said stopping means being actuated by a signal from said discrimination means.

8. A bobbin conveying system as claimed in claim 7, wherein said stopping device comprises a shaft, a plate swingable about said fixed shaft having first, second and third rollers mounted thereon and a cam plate in abutting contact with said first roller, said cam plate being fixedly mounted on a rotary solenoid actuated by said signal from said discrimination means, wherein when said solenoid is actuated said solenoid causes said cam plate to move said first roller thereby swinging said plate about said shaft so that said second roller contacts and stops said tray on said bobbin ejecting line.

9. A bobbin conveying system as claimed in claim 8, wherein said second roller of said plate contacts said tray at said bobbin receiving position, said third roller restrains said succeeding tray and said first roller abuts said cam plate so that said roller moves with said cam plate thereby causing said plate to swing from said bobbin ejecting line.

* * * * *